United States Patent [19]

Lundgren

[11] 4,063,942

[45] Dec. 20, 1977

[54] METAL FLAKE PRODUCT SUITED FOR THE PRODUCTION OF METAL POWDER FOR POWDER METALLURGICAL PURPOSES, AND A PROCESS FOR MANUFACTURING THE PRODUCT

[75] Inventor: Bengt G. S. Lundgren, Ulricehamn, Sweden

[73] Assignee: SKF Nova AB, Goteborg, Sweden

[21] Appl. No.: 686,938

[22] Filed: May 17, 1976

Related U.S. Application Data

[63] Continuation-in-part of Ser. No. 634,318, Nov. 24, 1975, abandoned.

[30] Foreign Application Priority Data

Nov. 26, 1974 Sweden ..... 7414810

[51] Int. Cl.[2] ..... B22D 23/08

[52] U.S. Cl. ..... 75/251; 75/.5 C; 264/8

[58] Field of Search ..... 75/.5 B, .5 BA, .5 BB, 75/.5 BC, .5 C, 251; 264/8

[56] References Cited

U.S. PATENT DOCUMENTS 3,151,971 10/1964 Clough ..... 75/.5 B

FOREIGN PATENT DOCUMENTS 2,127,563 12/1972 Germany ..... 75/.5 B

*Primary Examiner*—W. Stallard
*Attorney, Agent, or Firm*—Daniel M. Rosen

[57] ABSTRACT

A steel flake product, suitable for being crushed or ground to form a steel powder for powder metallurgical purposes, consists of a plurality of relatively thin, brittle and easily crushed, substantially dendrite-free steel flakes of amorphous to compact-grained structure. Such steel flakes are produced by causing molten steel to form at least one discrete, relatively thin flake-shaped layer on a relatively cold metal surface of great cooling capacity, moving rapidly and substantially across the direction of delivery of the molten steel. Due to the great cooling capacity the layer is made to solidify extremely rapidly.

12 Claims, 3 Drawing Figures

METAL FLAKE PRODUCT SUITED FOR THE PRODUCTION OF METAL POWDER FOR POWDER METALLURGICAL PURPOSES, AND A PROCESS FOR MANUFACTURING THE PRODUCT

CROSS REFERENCES TO RELATED APPLICATIONS

This application is a continuation in part of applicant's copending application, Ser. No. 634,318, filed Nov. 24, 1975, now abandoned.

FIELD OF THE INVENTION

The present invention relates to a new metal product, namely a metal flake product suited for the production of metal powder for powder metallurgical purposes, and to a process for manufacturing the metal flake product.

DESCRIPTION OF THE PRIOR ART

It is already known how to manufacture metal powder for powder metallurgical purposes by finely distributing or "atomizing" molten metal, the small drops produced being made to solidify to form small granules, each one of which constitutes an ingot of the molten metal. These small granules can subsequently be charged into a container which thereafter is evacuated and sealed, after which compacting under heat is carried out in order to join together the small granules into a solid metal compact with the composition of the molten metal. This method has proved extremely valuable for the production of homogeneous materials from melts of alloys susceptible to liquation, e.g. high-alloy steel, such as high speed steels, and other high-alloy material such as stellite.

The desired atomization of molten metal into small drops is usually brought about by an inert gas, such as argon or nitrogen, being made to impinge as high speed jets upon a pouring stream, but water and steam have also been used. Both water and steam are however, unsuitable for e.g. high speed steel, since they cause severe oxidation of the granules. It is also known how to atomize the pouring stream with the aid of a rotating disk and to make the small drops or ingots formed solidify through contact with the surrounding atmosphere or by being made to fall into a cooling-water or oil bath, having been perhaps subjected to a coolant shower. British Pat. Specification No. 519,624 relates to powdered or granular metallic products constituted by solidified metallic particles derived from molten metal, and it also describes a method of producing the products. The solidified metallic particles have spontaneously crystallized from a metastable undercooled state at a predetermined temperature below but close to the freezing point of the metal, said particles being of substantially uniform size and mutually uniform composition.

To produce the particles, molten metal is discharged from a suitable receptacle in one or more streams onto a metal surface of such nature that sufficient heat is abstracted from the molten metal to lower the temperature thereof to the so-called plastic range; i.e., to a point which is slightly below the freezing point of the particular metal but without causing solidification or crystallization. This surface upon which the molten metal impinges is rapidly moving either linearly as in the case of a belt or rotatively as in the case of a disk. In either event, the molten metal is immediately converted into a stream of film-like proportions on the surface and the extent of the belt or disk surface is such that the molten metal contacts therewith for a period just sufficient to undercool it as above defined. Then the molten metal is caused to leave the supporting surface and to continue its travel in the same direction and at substantially the same speed for a sufficient distance to cause solidification, but due to the face that the undercooled stream of film-like proportions has little or no inherent strength, it immediately breaks up into a myriad of fine, small liquid particles which, when they solidify as above set forth, result in the formation of a powdered metal.

These operations may be carried out in a vacuum or suitable atmosphere, and the myriad of fine, small liquid particles may be made to pass through a coolant in order to hasten solidification of the particles or to reduce the distance through which they need to be projected to effect solidification. As solidification takes place after the molten metal has left the belt or disk surface, surface tension will cause the particles to assume a substantially spherical shape, and even though the cooling rate may be comparatively high, it is not high enough to prevent a considerable formation of dendrites, as explained below.

In a successful method of producing high speed steel powder (see e.g. Teknisk Tidskrift, 1974:16, pp. 18–23) a pouring stream is atomized at the top of a high tower with the aid of argon jets, and the small drops formed are made to fall down through the argon-filled tower. Whilst falling, the drops solidify into mainly spherical granules with a grain size of up to about 700 μm. The tower must be sufficiently high, about 10 m, for the small spheres to have solidified sufficiently while falling not to stick together in a powder aggregate when they reach the bottom of the tower. In order to eliminate the risk of sticking together, it has been proposed that the solidified spheres should be collected in a container with liquified gas, placed at the bottom of the tower.

Granules produced by the above mentioned conventional methods have solidified considerably faster than normal large ingots, and it has been possible to achieve cooling rates of up to about $10^3$ ° C/s. The granules produced have not however been able to fulfill the high quality demands imposed upon them. On one hand they have contained dendrites, although of smaller size than those obtained during the solidification of large ingots, and on the other they have contained inert gas used during atomization and/or cooling, and dissolved and/or trapped in the molten metal. In addition, in certain production processes the surface of the granules has been affected chemically, e.g. by oxidation or decarburization. Dendrites are fast growing crystals with many branches and a tree-like structure, formed during the solidification of an ingot. Molten metal of a different composition from that in the dendrites is enclosed between the branches, which leads to inhomogeneities in the ingot.

SUMMARY OF THE INVENTION

The object of the present invention is to provide a new metal product which is well suited for the manufacture of substantially dendrite-free metal powder intended for powder metallurgical purposes, which has an amorphous to compact-grained structure and a chemically unaffected surface, and is free from dissolved and/or trapped gas.

According to the present invention, this new product is a metal flake product consisting of a plurality of relatively thin, brittle and easily crushed, substantially dendrite-free metal flakes of amorphous to compact-grained structure.

The brittleness of the flakes varies with their hardness. With flakes of hardened steel the hardness should be at least about HRC=60 to make them brittle and easy to crush.

According to the invention, the metal flake product can further be manufactured by causing molten metal, which is of such a composition that rapid cooling of thin layers of the melt results in relatively brittle, crushable films, to impinge in a vacuum or protective gas upon at least one relatively cold metal surface of great cooling capacity, moving rapidly and generally across the direction of delivery of the molten metal, to form at least one discrete, relatively thin, flake-shaped layer of molten metal on the metal surface, and causing the relatively thin layer to solidify extremely rapidly on the cold metal surface of great cooling capacity, to form a relatively thin, brittle and easily crushed, substantially dendrite-free metal flake of amorphous to compact-grained structure. The metal powder can then be produced simply by crushing or grinding the metal flakes, e.g. in a ball mill.

For ordinary tool steels, the temperature of the moving metal surface should always be a minimum of 200° C lower than the temperature at which solidification is completed.

Because the molten metal is made to form a thin layer or film on the cold metal surface of great cooling capacity, considerably faster solidification can be achieved than by the above mentioned conventional methods of producing spherical metal powder from a melt. Thanks to the extremely rapid solidification, an essentially completely dendrite-free, very fine-grained to amorphous structure is obtained, and only negligible quantities of protective gas have had time to dissolve in the melt. It is also possible to carry out solidification so rapidly that completely dendrite-free flakes are obtained, and by working in a vacuum the risk of absorbing protective gas into the melt can be eliminated. When using the process according to the invention, the cooling rate must be at least $10^4$ ° C/s, preferably at least about $10^5$ ° C/s, and expediently at least about $10^6$ ° C/s, at least in the temperature range for solidification.

To facilitate the breaking up of the metal flakes into powder of the required particle size, the parameters which determine the flakes' dimensions during manufacture should be so mutually adjusted that the thickness of the flakes is at the most about 0.5 mm, preferably at most about 0.1 mm. Expediently, the parameters are also so mutually adjusted that the ratio of the flakes' length to thickness is at least 100, the ratio of the flakes' width to thickness is at least about 20, and the ratio of the flakes' length to width is at most about 5.

DESCRIPTION OF THE PREFERRED EMBODIMENTS

Figure 1:
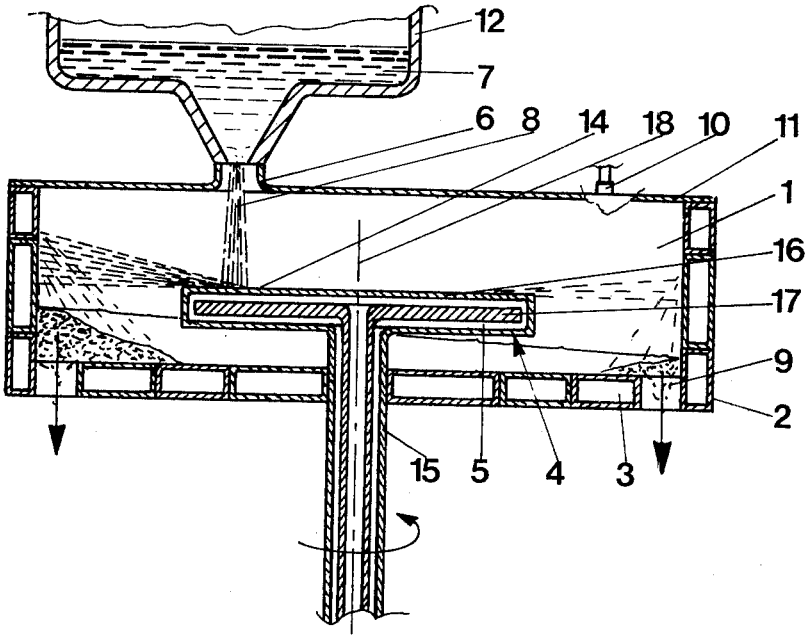
FIG. 1 is a view of a vertical cross section through a schematically illustrated embodiment of a device for carrying out the process according to the invention.

The device shown in FIG. 1 for manufacturing metal flakes incorporates a container 1, which in the embodiment shown is cylindrical and has a casing 2 and a bottom portion 3. Both casing 2 and bottom portion 3 are water-cooled, although no details are shown as to how the water cooling itself is achieved. The container 1 also has a cover 11 with an inlet orifice 6, to which is connected a casting box 12. The casting box 12 contains molten metal 7 of such a composition that rapid cooling of thin layers of the melt produces relatively brittle, crushable films. A conduit 10 connected to the cover 11 permits the container 1 to be placed under vacuum by means of a vacuum which is not shown, and/or to be charged with protective gas from a suitable source which is not shown.

The molten metal 7 from the casting box 12 is made to impinge upon a hard and relatively cold metal surface 14 of great cooling capacity, moving rapidly and substantially across the direction of delivery of the molten metal, to form at least one discrete, relatively thin, flake-shaped layer of molten metal on the metal surface 14. In the embodiment of the device shown, the metal surface 14 is the upper side of an internally cooled disk 4, which is located under the inlet orifice 6 and can rotate in the container. The disk is mounted on a driving shaft 15 extending out of the container 1. The disk 4 and driving shaft 15 are provided with internal conduits 5 for passage of the cooling water, and together form a "cold finger" type of cooling unit with an external part 16 and an internal part 17, of which at least the external part 16 is rotated by a motor which is not shown.

The disk 4, which in the embodiment shown is flat, circular and arranged in the horizontal plane, has its axis of rotation 18 displaced sideways in relation to the casting or tapping stream 8 dropping from the casting box 12, so that the stream 8 impinges eccentrically upon the rotating cooled disk 4. In this way a plurality of mutually spaced, relatively thin, flake-shaped layers of molten metal are formed on the cooled metal surface 14, which thanks to the great cooling capacity of the cooled metal surface 14 are made to solidify extremely rapidly on the latter, to form relatively thin, brittle and easily crushed, essentially dendrite-free metal flakes of amorphous to compact-grained structure. The metal flakes are thrown out against the water-cooled casing wall 2, and then fed out by means of suitable devices, which are not shown, through outlet holes 9 provided in the bottom portion 3 of the container. Because the brittle flakes are not to be used as such, but constitute an intermediate product, it does not matter if the discharge devices cause some crushing of the flakes.

Thanks to the great cooling capacity of the cooled metal surface 14, solidification takes place extremely rapidly. Within an interval of time, introduced when a drop of molten metal impinges upon the cooled metal surface 14 and terminated when the drop, converted into a thin solidified flake, leaves the cooled metal surface or has at least been cooled by the metal surface 14 to a temperature below the point of sticking, the cooling rate is extremely high, i.e. at least about $10^4$ ° C/s, preferably at least about $10^5$ ° C/s, and expediently at least about $10^6$ ° C/s.

The dimensions of the flakes produced depend on a number of parameters, of which the most important are the temperature of the melt 7, the pouring rate, the height of delivery, and the velocity of the cooled metal surface 14 at the point of impact of the casting stream 8. These parameters are so mutually adjusted that the metal flakes' thickness is at most about 0.5 mm, preferably at most about 0.1 mm. In the device shown, low r.p.m. of the disk 4 produce relatively thick flakes, and higher r.p.m. thinner flakes. This can be explained by the fact that, when the molten metal impinges upon the cooled metal surface 14, it first solidifies at the interface with the cooled metal surface 14 and is pulled by this through friction into rotation around the axis 18, whereas the molten metal lying on top is thrown outwards more easily due to inertia. The solidified flakes do not cling to the cooled surface 14, but the material in its entirely is thrown outwards.

Figure 2:
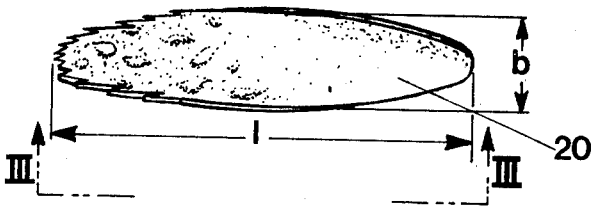
FIGS. 2 and 3 are a plan and a side view, respectively, of a metal flake made by the process.
Figure 3:
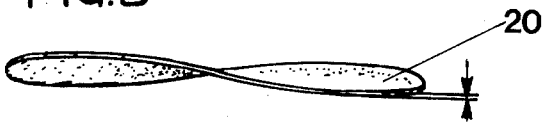

It is also expedient for the above quoted parameters to be so mutually adjusted that, as shown in FIGS. 2 and 3, the ratio of the metal flakes' 20 length "*l*" to thickness "*t*" is at least 100, the ratio of the flakes' width "*b*" to thickness "*t*" at least about 20, and the ratio of the flakes' length "*l*" to width "*b*" is at most about 5. Such flakes are easy to make, store and transport and to crush or grind into powder. The metal flakes 20 shown in FIGS. 2 and 3 are mainly oval or elliptical, and have a slight propeller-like twist about their longitudinal axis. One end of the flake has a relatively even edge, whilst the edge at its other end is relatively uneven, as a result of the solidifying process described above. FIG. 2 also shows that the surface of the metal flake 20 is relatively rough.

Since the brittleness of a flake varies with its hardness, the hardness of a flake of hardened steel should be at least about HRC=60 to make the steel flake brittle and easy to crush. For example, flakes made from SAE 52100 (1.0%C, 0.3%Mn, 1.5%Cr, balance Fe) has a hardness of HRC=60 and are brittle and easy to crush. After crushing, the resulting powder particles have a hardness in the range of HRC=70 to HRC=72 due to strain hardening.

As to the temperatures, that of the molten SAE 52100 steel 7 in the casting box 12 is preferably in the range of 1600° to 1650° C, i.e. about 150° C above a temperature at which austenite starts precipitating from the molten solution. The inlet temperature of the cooling water passed through the rotating disk 4 varies between about 5° C in winter-time and 15° C in summer-time. Presuming batch-wise operation the initial temperature of the cooled metal surface 34 will, thus, be about 10° C as an average. With a casting aperture of 8 mm diameter provided in the bottom of the casting box 12, the steel flakes will be produced at a rate of slightly higher than 0.7 kg/s, and the rate of the temperature rise will initially be rather steep. It will take about 14 minutes to produce 600 kg of steel flakes, and then the temperature 0.1 mm below the surface 34 of the disk will be about 900° C. A temperature of 1000° C will be reached after about 34 minutes, but it would take about 108 minutes (extrapolated value) to reach a maximum permissible temperature of 1100° C. A normal batch of molten steel is about 3 tons and will be processed in about 70 minutes under the above conditions. Thus, the temperature differential from the molten steel varies from about 1600° C at the beginning to at least about 550° C at the end of the processing of a 3 ton batch.

To reduce the rate of the temperature rise it is possible to let the pouring stream 8 impinge upon the circular disk 4 at a greater distance from its axis 18 while simultaneously reducing the r.p.m. of the disk to keep the relative speed of the disk at the impingement point unchanged. The relative speed preferably is in the range of about 10 to about 15 m/s.

During an experiment with the device shown in FIG. 1, the molten metal 7 consisted of high speed steel at a temperature of 1600° C, the pouring stream had a diameter of about 10 mm, and the height of delivery was 500 mm. The cooled disk 4 had a diameter of 250 mm and rotated at 30 $s^{-1}$, and the pouring stream 8 impinged upon the circular disk 4 at about 70 mm from the latter's periphery. This produced mainly elliptical flakes which looked like those in FIGS. 2 and 3 and had a length "" of about 70 mm, a width "*b*" of about 12 mm and a thickness "*t*" of about 0.1 mm. The flakes had solidified extremely rapidly, the cooling rate was about $10^6$° C/s, and the flakes were completely free of dendrites and had an amorphous structure, and due to their very high hardness they were also very brittle and very easy to crush.

Half the high speed steel flakes were ground in a ball mill into a metal powder of irregularly cornered particles (the majority of the particles could be described as micro-flakes), and the metal powder was charged into a cylindrical container and vibration compacted. The other half of the flakes were put straight into an identical container, and a weight in the form of a cylindrical disk was placed on top of the flakes, after which vibration compaction was carried out. Thereby, the flakes were crushed against each other, and the crushed material was compacted to a predetermined apparent density. Both containers were evacuated, sealed and then heated to the intended compacting temperature (about 1150° C) and transferred to a high pressure chamber, in which they were isostatically blast-compacted by the direct action on the containers of gases obtained from a low explosive introduced into the high pressure chamber. After cooling, it could be established that both the high speed steel pieces produced had throughout completely pore-free, even and extremely fine-grained structures.

A very great advantage of the process according to the invention is the possibility of working under a vacuum, which produces very low oxygen contents. In the example quoted above with high speed steel, the oxygen content amounted to only 16 ppm.

The invention is not restricted to the example illustrated and described, but can be modified in various ways within the scope of the claims below. The disk can, for example, be made bowl-shaped instead of flat, and it can be arranged at an angle to the horizontal plane. In addition, metallic cooling bodies other than rotating disks can be used, provided that they have a sufficiently low temperature and large cooling capacity, and that they move sufficiently fast substantially across the direction of delivery of the molten metal to produce exceptionally rapidly solidified metal flakes. When using a vacuum, a certain fragmentation of the pouring stream takes place even before it impinges upon the rotating cooled disk, and this fragmentation is due to the gas dissolved in the melt escaping.

What is claimed is:

1. A steel flake product suited for the production of steel powder for powder metallugical purposes, characterized in that it consists of a plurality of thin, brittle and easily crushed, substantially dendrite-free steel flakes of amorphous to compact-grained structure.

2. A steel flake product according to claim 1, in which the flakes have a hardness of at least HRC=60.

3. A steel flake product according to claim 1, in which the flakes' thickness is at most about 0.5 mm.

4. A steel flake product according to claim 3, in which the flakes' thickness is about 0.1 mm.

5. A steel flake product according to claim 3, in which the ratio of the flakes' length to thickness is at least 100, the ratio of the flakes' width to thickness is at least about 20, and the ratio of the flakes' length to width is at most about 5.

6. A process for manufacturing a steel flake product suited for the production of steel powder for powder metallurgical purposes, which comprises causing molten steel, which is of such a composition that rapid cooling of thin layers of the melt produces brittle crushable films, to impinge, in a vacuum or protective gas, upon a cold metal surface of great cooling capacity maintained at a temperature at least 200° C. lower than the solidification temperature of the molten steel and moving rapidly and substantially across the direction of delivery of the molten steel, to form a discrete, thin flake-shaped layer of molten steel on the metal surface, thereby causing the thin layer to solidify rapidly on the cold metal surface to form thin, brittle and easily crushed substantially dendrite-free steel flakes of amorphous to compact-grained structure.

7. A process according to claim 6, in which the cooling rate is at least about $10^4$ ° C/s in the temperature range of solidification.

8. A process according to claim 7, in which the cooling rate is at least about $10^6$ ° C/s.

9. A process according to claim 6, wherein the flakes produced have a thickness of at most about 0.5 mm.

10. A process according to claim 9, wherein the flakes produced have a thickness of about 0.1 mm.

11. A process according to claim 9, wherein the ratio of the flakes' length to thickness is at least 100, the ratio of the flakes' width to thickness is at least about 20, and the ratio of the flakes' length to width is at most about 5.

12. A process according to claim 6, in which the flakes produced have a hardness of at least HRC=60.

* * * * *

UNITED STATES PATENT AND TRADEMARK OFFICE

CERTIFICATE OF CORRECTION

PATENT NO. : 4.063,942

DATED : December 20, 1977

INVENTOR(S) : Bengt G.S. Lundgren

It is certified that error appears in the above-identified patent and that said Letters Patent are hereby corrected as shown below:

Column 1, line 48 after " been " insert --first--.

Column 2, line 9 change "face" to --fact--.

Column 6, line 12 change " "" " to --"1"--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*